United States Patent [19]

Winberg

[11] 4,026,229

[45] May 31, 1977

[54] LEECH LINE LOCKING DEVICE

[75] Inventor: Stefan Georg Winberg, Osterskar, Sweden

[73] Assignee: Gran Segel Bromma Yachting AB, Vallingby, Sweden

[22] Filed: May 27, 1976

[21] Appl. No.: 690,561

[30] Foreign Application Priority Data

June 2, 1975 Sweden ..... 7506261

[52] U.S. Cl. ..... 114/102; 114/114; 24/130

[51] Int. Cl.[2] ..... B63H 9/10

[58] Field of Search ..... 114/102, 108, 103, 104, 114/105, 106, 107, 112, 114, 109; 24/130, 117, 121; D8/229, 232

[56] References Cited

UNITED STATES PATENTS

| | | | |
|---|---|---|---|
| 667,939 | 2/1901 | Frye | 24/117 R |
| 2,620,760 | 12/1952 | Melges | 114/103 |
| 3,459,149 | 12/1969 | Hallmark | 114/103 |

FOREIGN PATENTS OR APPLICATIONS

| | | | |
|---|---|---|---|
| 414,300 | 6/1925 | Germany | 114/102 |
| 454,994 | 1/1928 | Germany | 114/102 |
| 1,807,659 | 1/1973 | Germany | 114/102 |
| 905,732 | 9/1962 | United Kingdom | 114/102 |
| 881,696 | 11/1961 | United Kingdom | 114/114 |

*Primary Examiner*—Trygve M. Blix
*Assistant Examiner*—Sherman D. Basinger
*Attorney, Agent, or Firm*—Flynn & Frishauf

[57] ABSTRACT

A leech line cleat comprises a plate member having a lengthwise through-running slot therein in which the edge of a sail is entered and fastened. The plate member has a further path therein through which a leech line is passed, and a locking device, such as a generally V-shaped groove, in communication with the leech line path for locking the leech line relative to the cleat and sail. Preferably, the leech line path is a hollow space in communication with the slot and the generally V-shaped groove is formed in a wall defining the hollow space for the leech line.

11 Claims, 6 Drawing Figures

LEECH LINE LOCKING DEVICE

This invention relates to improvements in locking devices, and more particularly to improvements in leech line locking devices, also known as leech line cleats.

A leech line or leech rope extends in the leech and/or foot of a sail and can be locked in different positions by means of a leech line cleat, which is usually placed close to the clew of the sail. A leech line cleat is exposed to great strain and wear due to its exposed position on the sail. Primarily this wear appears at tacks, when the clew of the foresail flutters against the shroud and forestay. The leech line cleat, which is often placed close to the clew, is often then smashed or gets stuck and is torn off.

A problem with prior art leech line cleats is that they can only be placed on one side or the other of the sail, which makes the accessibility limited when it happens to be on the outside of the sail.

A further problem with some so-called side mounted leech line cleats is the fact that when the sail is sheeted the space for loosening the leech line is limited. Under certain conditions it can even be impossible to loosen the leech line.

An object of the present invention is to provide an improved device for locking a leech line and to overcome the above disadvantages of the prior art devices.

SUMMARY OF THE INVENTION

According to the present invention, a locking device for locking a leech line in a sail includes a plate member having a lengthwise through-running slot therein into which the edge of the sail is entered and fastened, means defining a path in the plate member through which the leech line may be passed, and means in communication with the leech line path for locking the leech line to said locking device, thereby locking the leech line relative to the sail.

In a preferred embodiment, the locking means comprises a generally V-shaped groove formed in a wall portion of the plate member which defines the leech line path, the leech line being entered into said groove for locking same relative to the locking device. The width of the groove tapers to a dimension smaller than the diameter of the leech line to insure secure locking of the leech line in the groove when it is inserted in the groove.

DETAILED DESCRIPTION OF THE DRAWINGS

Figure 4:
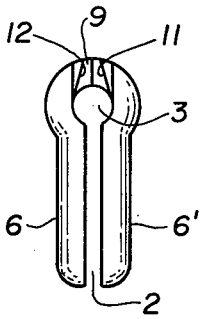
FIG. 4 is an end view of the leech line cleat taken from the right in FIG. 1 without the sail being shown.

Referring to FIGS. 1–4 a leech line cleat of the present invention comprises a plate member 1 with a slot 2 (FIG. 3) formed lengthwise of the plate 1 so that the plate 1 defines spaced apart legs 6,6'. The bottom of slot 2 is arranged as a lengthwise hollow space 3 in which the leech line 4 extends. The edge of the sail 5 is inserted into the slot 2 and the two legs 6,6' of the leech line cleat are fastened to the sail 5 by two through-running rivets 7. Screws could be used in place of the rivets 7. Sewing or glueing are other ways of fastening the leech line cleat to the sail 5. All corners 8 of the leech line cleat are smoothly rounded in order to give the best possible adhesion to the sail and to prevent the leech line cleat from becoming fastened to any part of the boat it gets in touch with. At one end of the lengthwise hollow space 3 there is a generally V-shaped groove 9 which forms the locking device for the leech line. The generally V-shaped groove 9 is delimited mainly by the faces 11,12 as best seen in FIG. 4.

The leech line 4 which extends in the fold along the edge of the sail 5, emerges into an eyelet 10 from the fold and further on it enters into the hollow space 3. From there the line 4 emerges into the V-shaped groove 9 in which it can be locked in different positions. The V-shape of the groove 9 facilitates entry of the leech line 4 therein for locking. As an extra safety precaution against unintended unlocking, the line 4 can be led back and under itself at the uncovered part of the line 4 between the eyelet 10 and the leech line cleat.

The V-shaped groove is dimensioned such that the leech line may be easily inserted therein at the widest portion or mouth of the groove and such that the groove tapers to a dimension smaller than the diameter of the leech line 4 to insure proper locking of the leech line 4 in the groove when it is inserted in the groove. The more deeply the leech line 4 is inserted in the groove 9, the more tightly it will become locked therein.

While the groove 9 is shown as being generally V-shaped, it should be clear that other equivalent shapes, such as U-shaped, or the like, could be used. The critical feature is that a wide portion be provided for easy insertion of the leech line and that the groove narrow down to a dimension small enough to firmly lock the leech line 4 relative to the cleat. Moreover, while the faces 11,12 which delimit the groove 9 are shown as being flat faces, they may take any other desirable shape. Still further, while the hollow space 3 through which the leech line passes is shown as being generally circular in cross-section, it should be clear that any other shape may be provided, the main requirement being that the hollow space 3 be dimensioned to permit passage of a leech line 4 therethrough.

Figure 1:
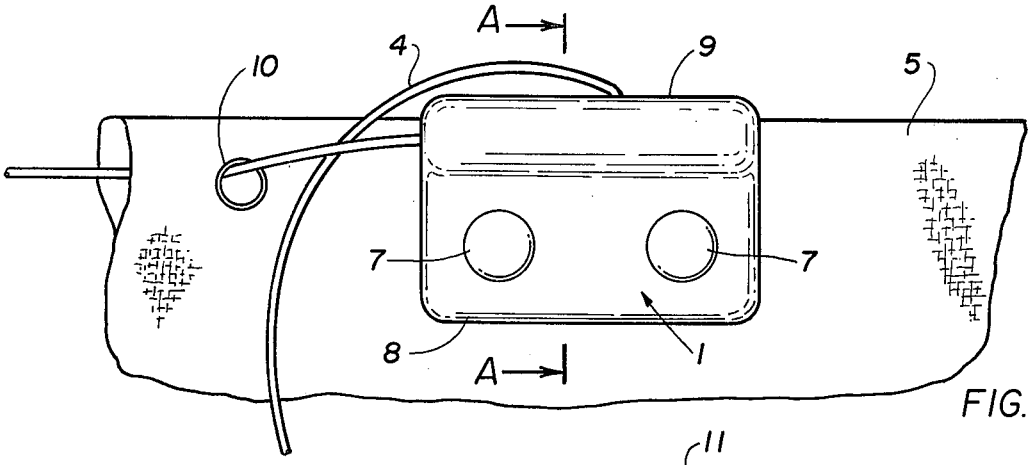
FIG. 1 shows a view of a leech line cleat according to the present invention mounted on a sail.
Figure 2:
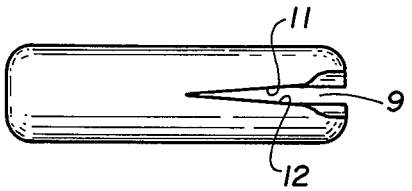
FIG. 2 shows the leech line cleat of FIG. 1 seen from above in FIG. 1.
Figure 3:
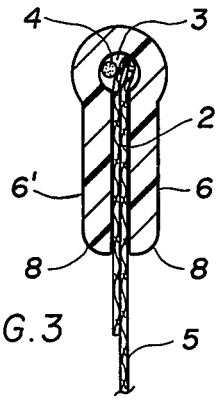
FIG. 3 is a cross-sectional view taken along line A—A of FIG. 1.

The generally V-shaped groove provides another advantage in that it facilitates mounting of the cleat on the sail 5. A preferred mounting procedure is to first engage an edge of the sail in the enlarge part of the V-shaped groove 9 (wherein the sail most easily fits) and then rotate the cleat counterclockwise (as seen in FIG. 1) to easily and gradually engage the sail 5 in the slot 2 defined between legs 6,6'. This procedure makes mounting of the cleat easy even when there is a very tight fit of the sail 5 in the slot 2.

Figure 6:
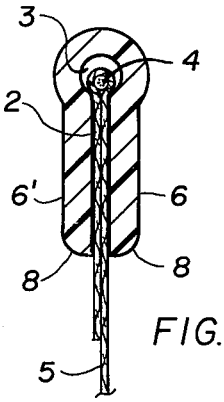
FIG. 6 is a cross-sectional view taken along line B—B in FIG. 5.
Figure 5:
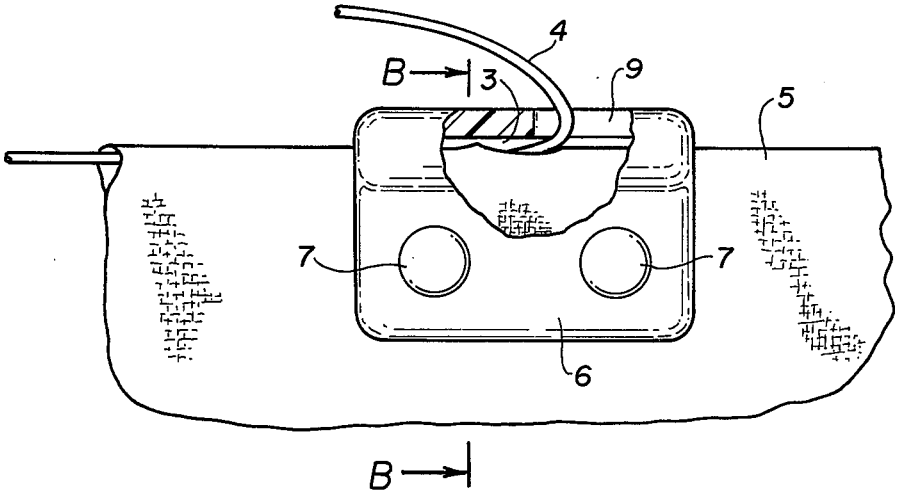
FIG. 5 shows the leech line cleat of the present invention in another position on a sail.

In FIGS. 5 and 6 another placement of the leech line cleat on a sail is shown where the leech line 4 emerges from the sail fold directly into the lengthwise hollow space 3 of the leech line cleat.

In the FIGS. 5 and 6 arrangement, the cleat is placed somewhat further out from the edge of the sail 5 in order to make certain that the leech line 4 runs smoothly and that it does not get jammed when loosened. Locking of the leech line 4 in the generally V-shaped groove 9 is the same as described above with reference to FIG. 1 except that the line 4 cannot be led back and under itself.

The leech line cleat of the present invention is designed so that it adheres well to the shape of the sail and cannot get inadvertently stuck in the various different parts of the boat. Futhermore, the leech line emerges into and can even be locked in the edge of the sail, which gives accessability from both sides of the sail and which makes trimming possible in all different positions of the sail. When loosening the leech line it can be moved on one side or the other of the sail, which enables a safe loosening even when the sail is sheeted.

The leech line cleat may be fabricated from plastic materials either by molding or machining, or could be fabricated from metal material.

When the invention has been described above with respect to specific embodiments, the invention is not limited to the specific embodiments described and shown, but the invention may be carried out with various design modifications within the scope and spirit of the inventive concept as defined in the appended claims.

I claim:

1. A locking device for locking a leech line relative to a sail, comprising:

a plate member (1) having two spaced apart side members (6) defining a through-running slot (2) there-between therein for receiving an edge of a sail (5) in at least a portion of said slot (2), said slot (2) terminating in lengthwise running hollow space (3) in said plate member (1) in open communication with the portion of said slot which receives an edge of a sail (5), said space (3) receiving a leech line (4) passing through at least a portion of said space (3);

locking means (9) in open communication with said space (3) and the remainder of said slot (2) for locking said leech line (4) to said locking device, said locking means comprising a generally V-shaped groove (9) in a wall of said plate member (1) defining said space (3), said generally V-shaped groove having its largest dimension portion opening at an edge of said plate member (1) for wedgingly receiving the leech line (4) therein and for providing at the edge opening of said generally V-shaped groove an entry opening for receiving a sail (5) during attachment of the locking device to a sail (5); and means for fastening said plate member (1) to said sail (5) in said slot (2).

2. A locking device according to claim 1 wherein said generally V-shaped groove (9) is in the bottom of said space (3) which is remote from said remainder of said slot (2).

3. A locking device according to claim 1 wherein the minimum cross-sectional dimension of said hollow sapce (3) is larger than the maximum of the remainder of said slot (2).

4. A locking device according to claim 1 wherein said hollow space (3) is generally cylindrical in shape.

5. A locking device according to claim 1 wherein said fastening means comprises at least one rivet (7) passing through said plate member (1) and said sail (5).

6. A locking device according to claim 1 wherein said fastening means comprises adhesive means for adhering said plate member (1) to said sail (5).

7. A locking device according to claim 1 wherein said leech line (4) emerges from a fold of said sail (5) at a point spaced from said plate member (1), and wherein said hollow space (3) is arranged to receive said leech line (4) at an edge of said plate member (1).

8. A locking device according to claim 7 wherein said plate member (1) is fastened to said sail (5) such that the edge of said sail (5) enters into said hollow space (3) with the edge of the sail contacting the bottom of said hollow space (3), said bottom being the portion of said hollow space (3) most remote from the opening of said slot (2).

9. A locking device according to claim 1 wherein said leech line (4) emerges from a fold of said sail (5), and wherein said plate member (1) is mounted to said sail (5) over the portion of said sail whereat said leech line (4) emerges, said hollow space (3) being arranged and dimensioned to receive said leech line (4) where it emerges from said sail (5) at an intermediate portion of said hollow space (3).

10. A locking device according to claim 9 wherein said plate member (1) is fastened to said sail (5) such that the edge of said sail (5) enters into said hollow space (3) but does not touch the bottommost portion thereof, said bottommost portion being the portion of said hollow space (3) most remote from the opening of said slot (2).

11. A locking device according to claim 1 wherein all edges of said plate member are smoothly rounded.

* * * * *

UNITED STATES PATENT AND TRADEMARK OFFICE

CERTIFICATE OF CORRECTION

PATENT NO. : 4,026,229

DATED : May 31, 1977

INVENTOR(S) : Stefan Georg WINBERG

It is certified that error appears in the above-identified patent and that said Letters Patent are hereby corrected as shown below:

Column 4, line 11, change "sapce" to --space--;

after "maximum" insert --width--.

Signed and Sealed this

*sixteenth* Day of *August 1977*

[SEAL]

*Attest:*

RUTH C. MASON
*Attesting Officer*

C. MARSHALL DANN
*Commissioner of Patents and Trademarks*